US011053056B2

(12) United States Patent
Davidson et al.

(10) Patent No.: US 11,053,056 B2
(45) Date of Patent: Jul. 6, 2021

(54) ANTI-CLOG CAP AND ASSOCIATED CONTAINERS AND METHODS

(71) Applicant: Sanford, L.P., Atlanta, GA (US)

(72) Inventors: Craig P. E. Davidson, Cornelius, NC (US); Ryan Heiser, Kalamazoo, MI (US); Joseph Wayne Kreft, Atlanta, GA (US); Patrick Kevin Shields, Grand Rapids, MI (US)

(73) Assignee: Sanford, L.P., Atlanta, GA (US)

( * ) Notice: Subject to any disclaimer, the term of this patent is extended or adjusted under 35 U.S.C. 154(b) by 38 days.

(21) Appl. No.: 16/496,184

(22) PCT Filed: Apr. 13, 2018

(86) PCT No.: PCT/US2018/027540
§ 371 (c)(1),
(2) Date: Sep. 20, 2019

(87) PCT Pub. No.: WO2018/191649
PCT Pub. Date: Oct. 18, 2018

(65) Prior Publication Data

US 2020/0156830 A1 May 21, 2020

Related U.S. Application Data

(60) Provisional application No. 62/485,650, filed on Apr. 14, 2017.

(51) Int. Cl.
*B65D 47/24* (2006.01)
*B65D 47/06* (2006.01)
(Continued)

(52) U.S. Cl.
CPC ..... *B65D 47/242* (2013.01); *B65D 47/243* (2013.01); *B65D 47/06* (2013.01);
(Continued)

(58) Field of Classification Search
CPC ..... B65D 47/242; B65D 47/243
(Continued)

(56) References Cited

U.S. PATENT DOCUMENTS 4,438,870 A 3/1984 Stull
4,461,408 A 7/1984 Shepard
(Continued)

OTHER PUBLICATIONS

International Search Report and Written Opinion for International Application No. PCT/US2018/027540 dated Jun. 29, 2018 (20 pages).

(Continued)

*Primary Examiner* — Michael J. Melaragno
(74) *Attorney, Agent, or Firm* — Eversheds Sutherland (US) LLP

(57) ABSTRACT

Glue bottle anti-clog caps are provided. The anti-clog cap has a body with a mounting section for attaching the body to a glue bottle. The body of the anti-clog cap has a dispensing section that includes a central lumen extending from the second mounting end. The body of the anti-clog cap also has a tip section with a support rib protruding from an outlet of the dispensing section. The tip has a tip plug protruding from the support rib. The anti-clog cap has a nozzle that mates to the body and a tip orifice aligned with the tip plug of the body. The tip section is configured to allow the free flow of glue through the cap. The nozzle can rotate between an open and closed position. In the closed position the tip plug can extend into the tip orifice thereby preventing the flow of glue.

14 Claims, 9 Drawing Sheets

(51) Int. Cl.
*B65D 47/20* (2006.01)
*B65D 51/18* (2006.01)

(52) U.S. Cl.
CPC ..... *B65D 47/2031* (2013.01); *B65D 51/18* (2013.01); *B65D 2401/15* (2020.05)

(58) Field of Classification Search
USPC ..... 222/521
See application file for complete search history.

(56) References Cited

U.S. PATENT DOCUMENTS

| | | | | |
|---|---|---|---|---|
| 4,690,304 | A | 9/1987 | Morel | |
| 4,754,899 | A | 7/1988 | Stull | |
| 5,310,097 | A | 5/1994 | Leuenberger | |
| 5,320,260 | A | 6/1994 | Song et al. | |
| 5,377,873 | A | 1/1995 | Minnette | |
| 5,829,611 | A | 11/1998 | Beck | |
| 6,669,063 | B1 | 12/2003 | Schneider et al. | |
| 6,896,151 | B1 | 5/2005 | Robinson | |
| 2002/0113096 | A1* | 8/2002 | Valley, III | B65D 3/00 222/521 |
| 2002/0125273 | A1 | 9/2002 | Sittler | |
| 2003/0071085 | A1* | 4/2003 | Lasserre et al. | B65D 83/20 222/521 |
| 2014/0231468 | A1* | 8/2014 | Wade et al. | B65D 47/061 222/521 |

OTHER PUBLICATIONS

Gorilla Glue Bottles Updated with Anti-Clog Cap, https://toolguyd.com/gorilla-glue-bottles-updated-with-anti-clog-cap/ (4 pages) printed Sep. 20, 2019.

* cited by examiner

ANTI-CLOG CAP AND ASSOCIATED CONTAINERS AND METHODS

CROSS-REFERENCE TO RELATED APPLICATIONS

This application is a U.S. national stage application claiming priority to International Application No. PCT/US2018/027540, filed Apr. 13, 2018, which claims priority benefit of U.S. Provisional Application No. 62/485,650, filed Apr. 14, 2017, the disclosures of which are incorporated by reference herein in their entirety.

FIELD

This disclosure generally relates to containers for consumer pourable glues, and more particularly relates to a cap design for preventing clogging of the cap.

BACKGROUND

Currently, pourable glue containers are susceptible to clogging after use. After dispensing glue initially, residual glue that does not return to the glue container body dries, building up over time, and eventually clogging the cap. A clogged cap is undesirable because it often leads to reduced or obstructed flow and increased force required to open the cap. Once clogged, users may throw away the bottle despite any remaining volume of usable glue inside the bottle, or they may try to open the clogged hole with a foreign object such as a pin or paperclip or by soaking the bottle in warm water. In some instances, caps are provided with removable pins to help alleviate these issues; however, removable components are cumbersome, can allow glue to leak from the cap even with proper use, and are subject to being lost. In other instances, caps have been designed with integrated pins that extend through the outlet hole when in the closed position, to prevent glue from drying in the hole after use; however, such integrated pins may be susceptible to clogging.

A primary contributor to clogging is the configuration of the cap. The configuration of the cap can impact the ability of the glue to flow back into the bottle after use, resulting in the glue stalling on the cap, and components of the cap, where it can dry when exposed to air before making its way back into the bottle. Over time, this glue builds up, eventually leading to clogging. This type of buildup is especially prevalent when the glue forms a "soap bubble" effect, bridging between the internal geometries or surfaces of the cap via surface tension. This soap bubble prevents the glue from freely flowing back into the bottle after use, exposing the soap bubble glue to air within the cap, preventing proper closure of the cap, and increasing the volume of glue that may dry on the internal components of the cap after each use.

Another primary contributor to clogging is improper closure of the cap. Commonly, caps are inadvertently left open because the cap itself provides no easy indication for users, especially children, that the cap is closed completely.

Accordingly, a need exists for pourable glue containers and caps that overcome one or more of these disadvantages.

SUMMARY

In one aspect, an anti-clog cap for a glue bottle is provided, including a body that has a mounting section, a dispensing section, and a tip section. The mounting section of the body has an end adapted for attaching to the glue bottle. The dispensing section extends from a second end of the mounting section and has an inlet end and an outlet end. A central lumen extends from the inlet end and the outlet end of the dispensing section. The body of the anti-clog cap includes a tip section that extends from the outlet end of the dispensing section. The tip section includes a support rib that protrudes from the outlet end of the dispensing section. The tip section also includes a tip plug that protrudes from the support rib. The anti-clog cap has a nozzle that has a mating end to attach to the body of the anti-clog cap. The nozzle includes a tip orifice in alignment with the tip plug. The tip section of the body is configured to allow for the free flow of glue through the cap. The nozzle is configured to rotate between an open and a closed position. When the nozzle is in the closed position, the tip plug extends through the tip orifice in the nozzle and prevents the flow of glue through the orifice. When the nozzle is in the open position, the tip plug is positioned outside to the tip orifice to facilitate the free flow of glue through the tip orifice.

In another aspect, an anti-clog cap for a glue bottle is provided, including a body with a mounting end adapted for attaching the anti-clog cap to the glue bottle. The anti-clog cap includes a dispensing end configured for dispensing glue and an outer surface configured for rotational engagement with a nozzle. A central lumen extends between the mounting end and the dispensing end of the body. The anti-clog cap further includes a support rib, a tip plug, and a nozzle. The nozzle has a proximal end attached to the body and a distal end with a tip orifice. The support rib extends from the body and is configured to facilitate the flow of glue through the cap. The tip plug protrudes from the support rib and aligns with the tip orifice. The nozzle is configured to rotate between a closed position and an open position. When the nozzle is in the closed position, the tip plug extends into the tip orifice thus preventing the flow of glue through the orifice. When the nozzle is in the open position, the tip plug is positioned to facilitate the free flow of glue through the tip orifice.

In another aspect, an anti-clog cap for a glue bottle is provided, including a body configured to selective attachment to a glue bottle. The body includes an attachment end and a dispensing end with a tubular protrusion extending perpendicular to the top of the dispensing end. The tubular protrusion has an outer surface, an inner lumen, and a distal end. The distal end of the tubular protrusion has a support rib and a tip plug. The support rib allows glue to flow through the anti-clog cap body towards the glue bottle when the glue bottle is upright. The anti-clog cap also includes a nozzle attached to the body, and the nozzle has a tip orifice at one end. The nozzle is selectively movable between an open and a closed position. When the nozzle is in the closed position, the tip plug is within the tip orifice and prevents the flow of glue. When the nozzle is in the open position, the tip plug allows glue to flow through the tip orifice.

In yet another aspect, an anti-clog cap for a glue bottle is provided, including an anti-clog cap body. The anti-clog cap body includes a mounting section configured to mount the body onto a glue bottle. The anti-clog cap body also includes a dispensing section that has an inlet end, an outlet end, and a central lumen. The anti-clog cap includes a nozzle attached to the body and has a tip orifice. The anti-clog cap has a plug assembly with a tip plug and a plurality of fixation elements. The fixation elements position the tip plug coaxially along the longitudinal axis of the central lumen and the tip orifice. Additionally, the nozzle is rotatable between a closed and an open position. When the nozzle is in the closed position, the tip plug extends into the tip orifice and thus prevents the flow of glue through the tip orifice. When the tip nozzle is in the open position, the tip orifice is positioned distal to the tip plug to facilitate the flow of glue through the tip orifice.

DETAILED DESCRIPTION

Figure 1:
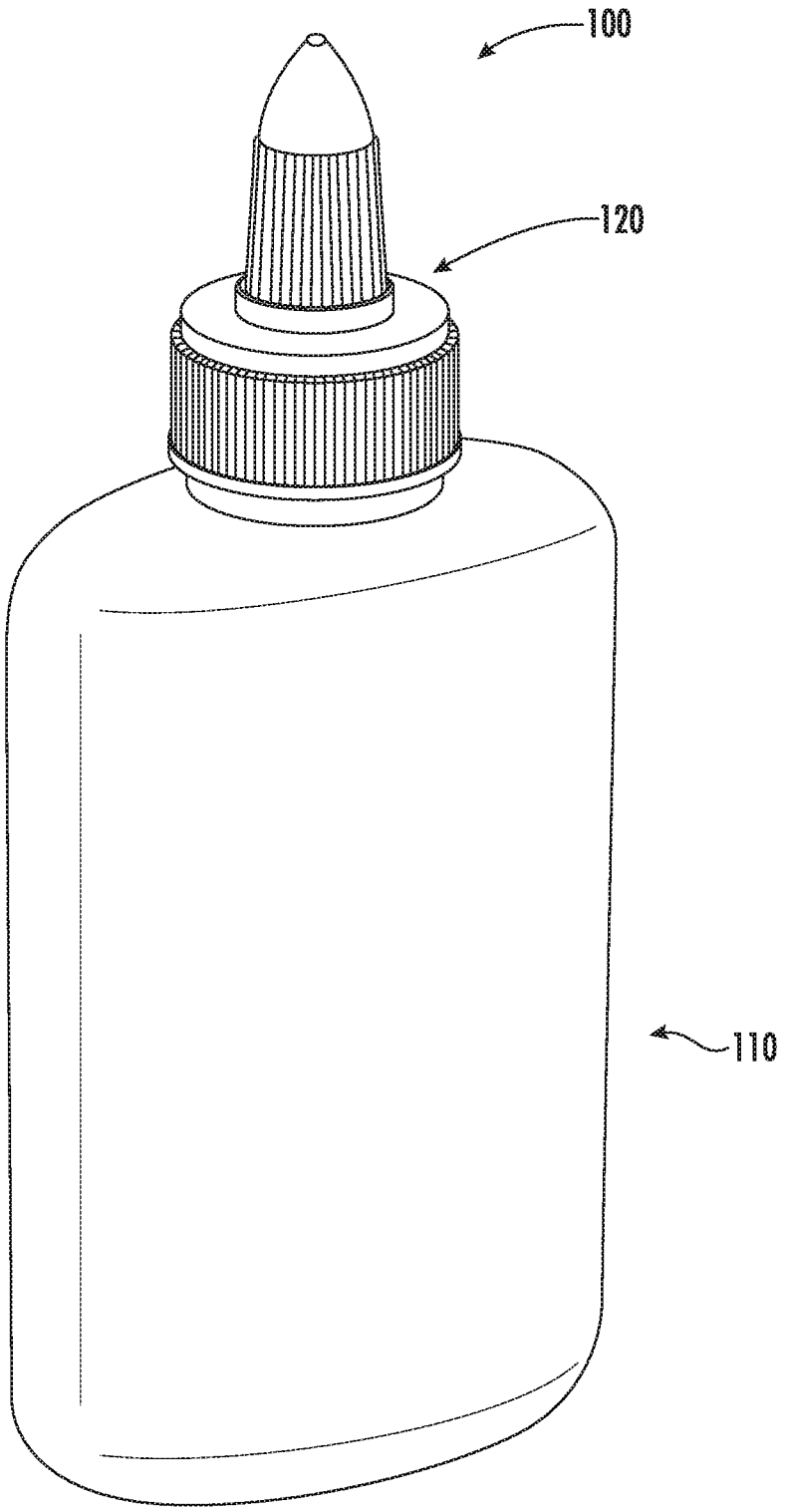
FIG. 1 is a perspective view of one embodiment of an anti-clog cap and a glue bottle.

The anti-clog cap described herein advantageously accommodates various pourable glues having a range of viscosities as well as various use applications. The present disclosure includes non-limiting embodiments of anti-clog caps for pourable glue bottles. The embodiments are described in detail herein to enable one of ordinary skill in the art to practice the anti-clog caps, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

The meanings of the terms used herein will be apparent to one of ordinary skill in the art or will become apparent to one of ordinary skill in the art upon review of the detailed description when taken in conjunction with the several drawings and the appended claims.

Figure 2A:
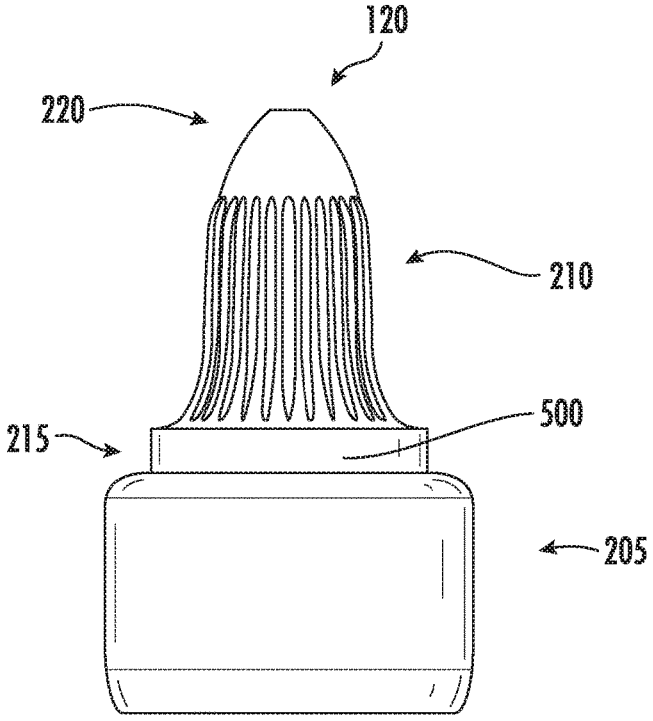
FIG. 2A is a front view of one embodiment of an anti-clog cap.
Figure 2B:
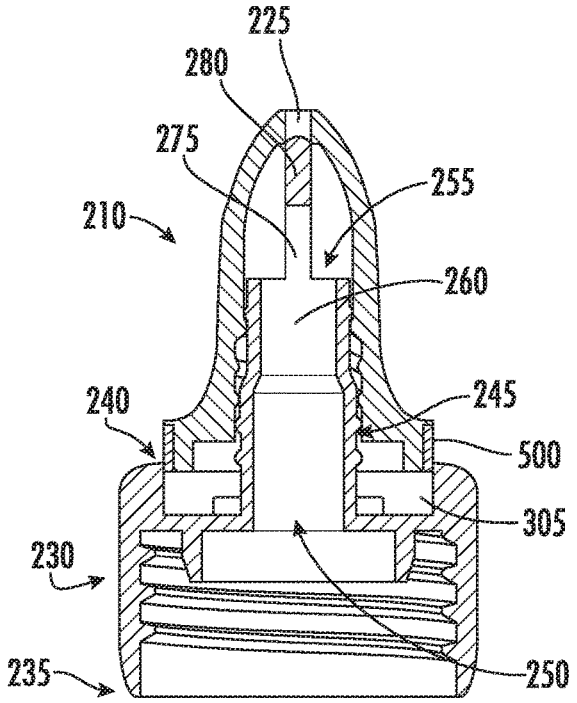
FIG. 2B is a cross-sectional side view of the anti-clog cap of FIG. 2A.
Figure 2C:
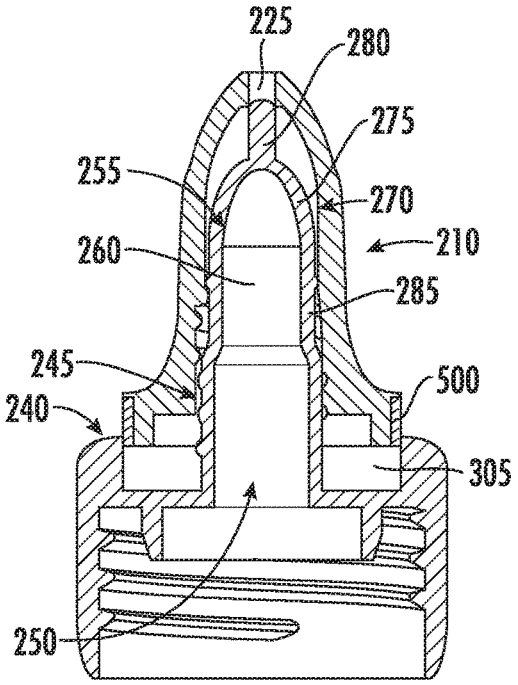
FIG. 2C is a cross-sectional front view of the anti-clog cap of FIG. 2A.

FIG. 1 illustrates a pourable glue container 100 in accordance with one or more embodiments of the disclosure. The glue container 100 includes a bottle 110 and an anti-clog cap 120, as described below. In particular, as shown in FIGS. 2A-2C, the anti-clog cap 120 includes a body 205 and a nozzle 210. Notably, FIGS. 2B and 2C provide cross-sectional views of the anti-clog cap 120, offset 90 degrees from one another. The nozzle 210 may include a mating end 215 that is adapted for attachment to the body 205, and a distal end 220 that includes a tip orifice 225. In one example embodiment, the mating end 215 may include female threads 227 for engaging with corresponding male threads 229 included on the body 205 and allowing for the cooperative engagement between the nozzle 210 and the body 205 which allows for rotational and axial displacement of the nozzle 210 and secures the nozzle 210 to the body 205.

In some exemplary embodiments, the body 205 may include a mounting section 230 that includes a first mounting end 235 and a second mounting end 240, and is adapted for mounting the body 205 to the bottle 110 of a glue container. The first mounting end 235 may include male threads 237 for engaging with corresponding male threads included on the glue bottle 110 and allowing for the cooperative engagement between the body 205 and the glue bottle 110 which allows for rotational and axial displacement of the body 205 and secures the body 205 to the glue bottle 110. While female-male threaded connections may be used as described herein, it should be understood that any suitable connection mechanisms for connecting elements of the containers (e.g., for connecting the nozzle and the body or the body and the bottle) may be used.

The body 205 may also include a dispensing section 245. As shown, the dispensing section 245 may extend distally from the second mounting end 240 and may include, an inlet end 250, adjacent to the second mounting end 240, an outlet end 255, opposite the inlet end 250, and a central lumen 260, extending between the inlet end 250 and the outlet end 255 to allow glue to pass through the body 205 of the anti-clog cap 120 when in use. As used herein, the terms "distally" and "proximally" refer to the position of components of the cap relative to the bottle of the container. The body 205 may also include a tip section 270. The tip section 270 may extend distally from the outlet end 255 and include a support rib 275 that protrudes distally from the outlet end 255 of the dispensing section 245, and a tip plug 280 that protrudes distally from the support rib 275 and in axial alignment with the tip orifice 225. Further details regarding the configuration of the nozzle 210 and the body 205, as well as the movement of the nozzle 210 relative to the body 205, are provided below.

The tip section 270 may be dimensioned to facilitate the free flow of glue through the anti-clog cap 120. As described above, the geometry of the cap for pourable glue bottles may impact not only the characteristics of the glue when poured, but also the propensity of the cap to clog over time. When the glue container is in use, the container is inverted, either fully or partially, allowing gravity and/or pressure applied by the user to flow glue from the bottle, through the cap, and onto a work surface. When not dispensing, the container may be returned to an upright position, such that gravity causes glue inside the cap 120 to flow back towards the bottle. Over a sufficiently small open area or distance, the cohesive forces between the glue molecules allow the glue to create a "film" capable of spanning open areas, while the adhesive forces between the glue and the components of the cap allow the glue to attach to adjacent components within the cap itself. This combination of cohesive and adhesive forces allow the glue to span open areas, creating a "film" or "soap bubble" effect that can dry and build up over time, leading to clogging. Without any type of closure or cap to seal the tip orifice of the nozzle, the generally small dispensing diameter will result in the buildup of glue in the orifice when the surface tension of the glue is sufficient to withstand the gravitational forces acting on the glue, urging it to flow back into the bottle. Similarly, as the glue flows back proximally over the internal elements of the cap, there are additional opportunities for the glue to adhere and create a film bridging the open spaces within the cap as it flows back into the bottle.

When glue creates a film over the tip orifice 225 of the nozzle 210, it can dry in place, clogging the cap. Accordingly, the anti-clog cap 120 may include a tip plug 280 that is integrated into the body 205 of the anti-clog cap 120. In certain configurations of the anti-clog cap 120, the nozzle 210 may be rotatable between a closed position and an open position, such that, when the nozzle 210 is in the closed position, the tip plug 280 extends into the tip orifice 225, substantially preventing the flow of glue through the tip orifice 225, and, when the nozzle 210 is in the open position, the tip plug 280 is positioned outside of and proximal to the tip orifice 225 (as shown in FIGS. 2B and 2C), to allow the free flow of glue through the tip orifice 225. By extending the tip plug 280 into the tip orifice 225 when closing the cap 120, some or all of the film covering the tip orifice 225 is displaced.

In order to minimize the buildup of film bridging between the internal components of the cap 120, and specifically about the support rib 275 and the central lumen 260, the interstitial spaces must be large enough that the cohesive forces in the glue are insufficient to create a film bridging the glue pathway. By dimensioning these spaces as described herein, the free flow of glue back into the bottle is maintained, meaning the glue cannot span the open space between the support rib 275 or the central lumen 260, preventing the buildup of dried glue across the glue pathways. As dimensioned and described herein, a large tolerance for variations in adhesive viscosity is achieved.

Figure 4A:
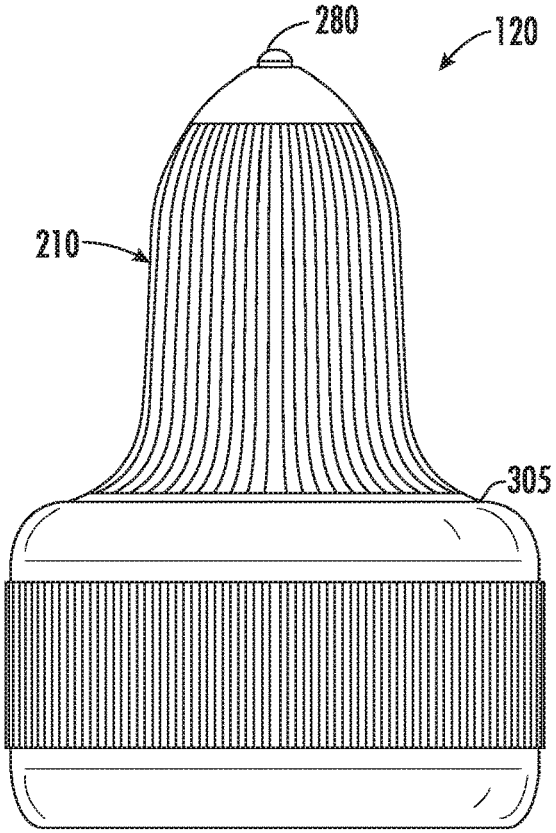
FIG. 4A is a front view of one embodiment of an anti-clog cap in a closed position.
Figure 4B:
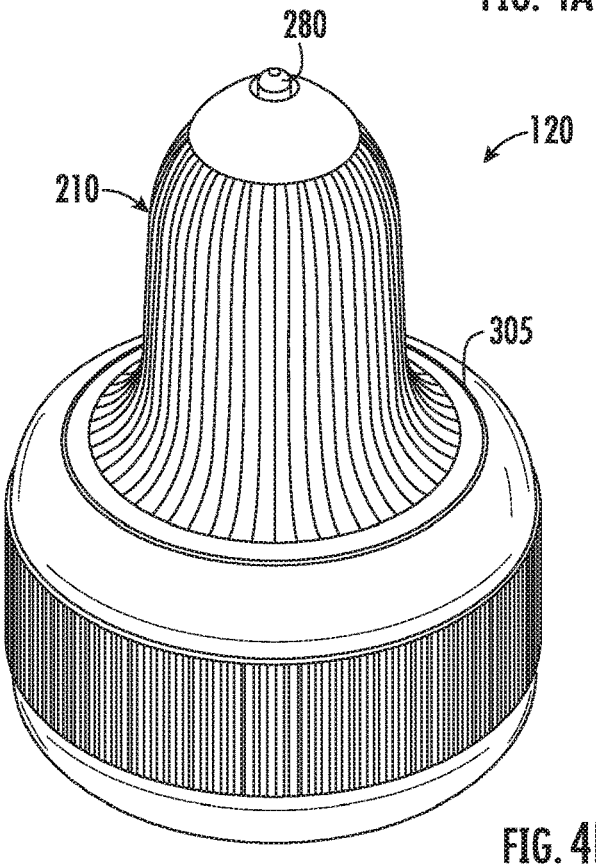
FIG. 4B is a top perspective view of the closed position anti-clog cap of FIG. 4A.
Figure 5A:
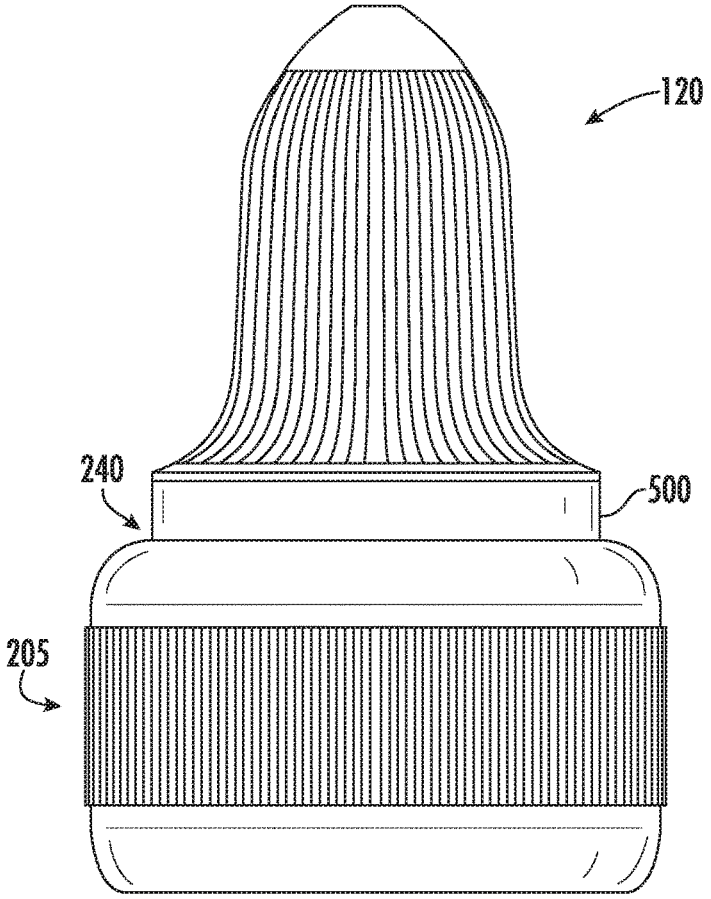
FIG. 5A is a front perspective view of the anti-clog cap of FIG. 4A in an open position.
Figure 5B:
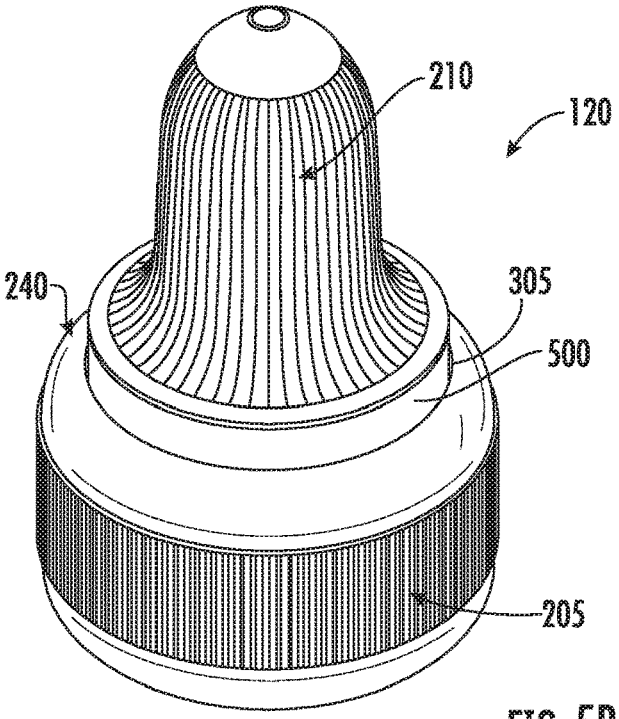
FIG. 5B is a top perspective view of the anti-clog cap of FIG. 4A in an open position.

In certain exemplary embodiments, the anti-clog cap 120 may include a status indicator to provide feedback to the user about whether the nozzle 210 is in the closed position or the open position. In one example, the status indicator may be a visual indicator. As shown in FIGS. 2A-C and 5A and 5B, the visual indicator may include a visualization element 500 disposed on, or a component of, the nozzle 210. In some embodiments, the second mounting end 240 of the cap body 205 may include a recess 305 as a component of the status indicator. In some exemplary embodiments, the visualization element 500 is configured such that when the nozzle 210 is in the open position, the visualization element 500 is visible as shown in FIGS. 5A and 5B, and when the nozzle is in the closed position, the visualization element 500 is positioned in the recess 305, hiding the visualization element from view as shown in FIGS. 4A and 4B. In some embodiments, the visualization element 500 may be a band of color that differs from the color of the rest of the nozzle 210, while in other embodiments, the visualization element 500 may include a pattern, surface treatment, or other design feature that visually differentiates the visualization element 500 from the rest of the nozzle 210. The visualization element 500 may be a component of the nozzle 210, such as a painted band, variations in texture, or a co-molded component where the visualization element 500 material is a different color or is constructed of a different material than the nozzle 210. In other embodiments, the visualization element 500 may be a separate component that is assembled onto the nozzle 210, such as a press or snap fit ring or shrink tubing. In other embodiments, the status indicator may be an audible or tactile indicator. In such embodiments, the nozzle 210 may include a first interference element, the body 205 may include a second interference element, and the two interference elements may be configured to provide audible or tactile feedback to the user when the nozzle 210 is rotated from the open position to the closed position.

Figure 6A:
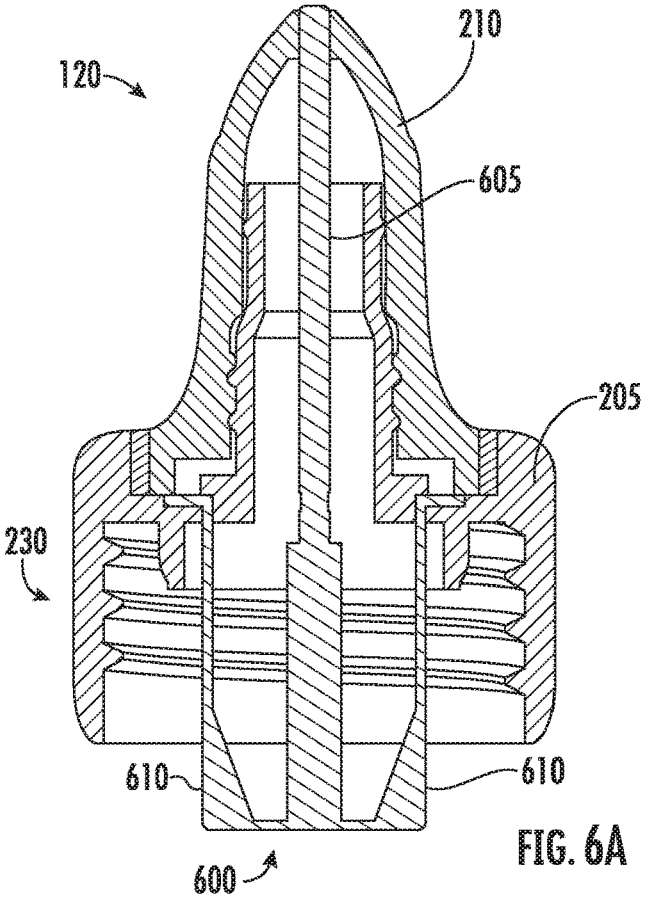
FIG. 6A is a cross-sectional front view of the anti-clog cap of FIG. 4A.
Figure 6B:
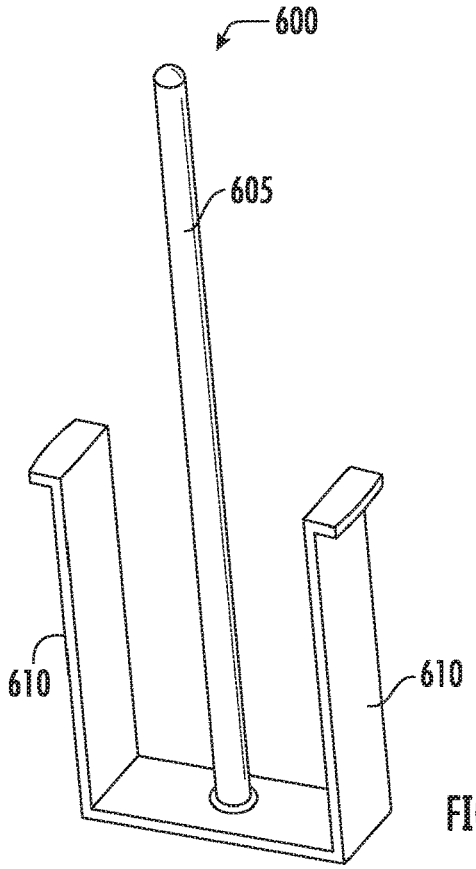
FIG. 6B is a perspective view of one embodiment of a plug assembly.
Figure 7A:
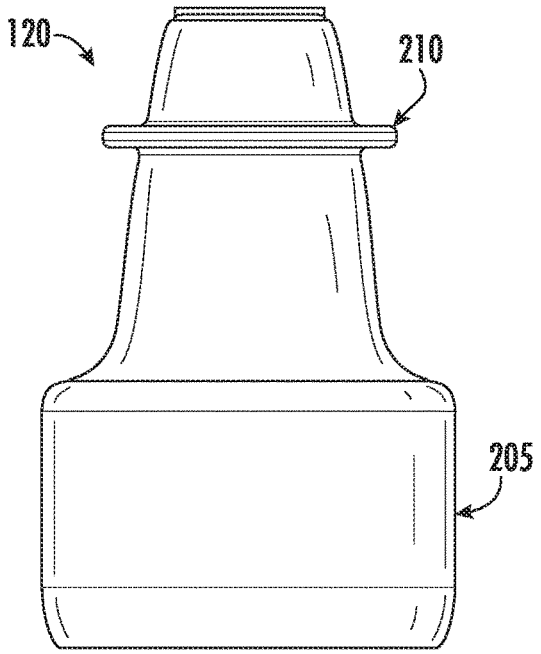
FIG. 7A is a front view of one embodiment of an anti-clog cap.
Figure 7B:
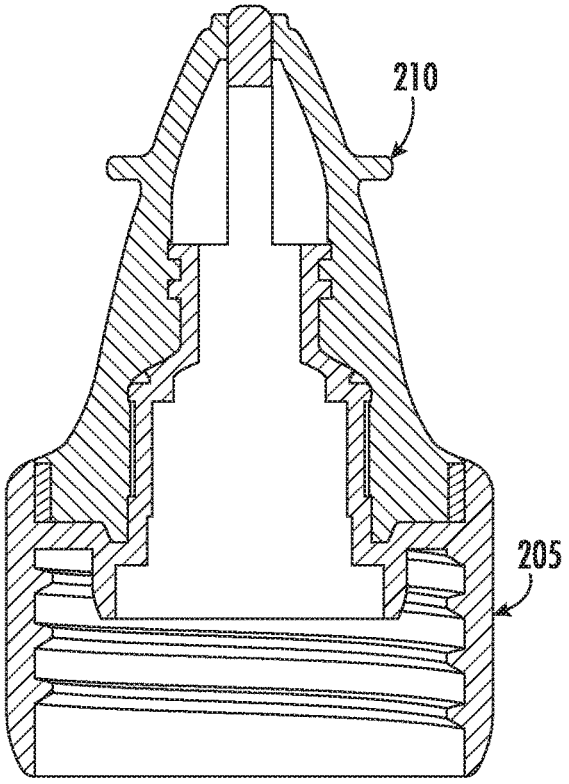
FIG. 7B is a cross-sectional side view of the anti-clog cap of FIG. 7A.
Figure 7C:
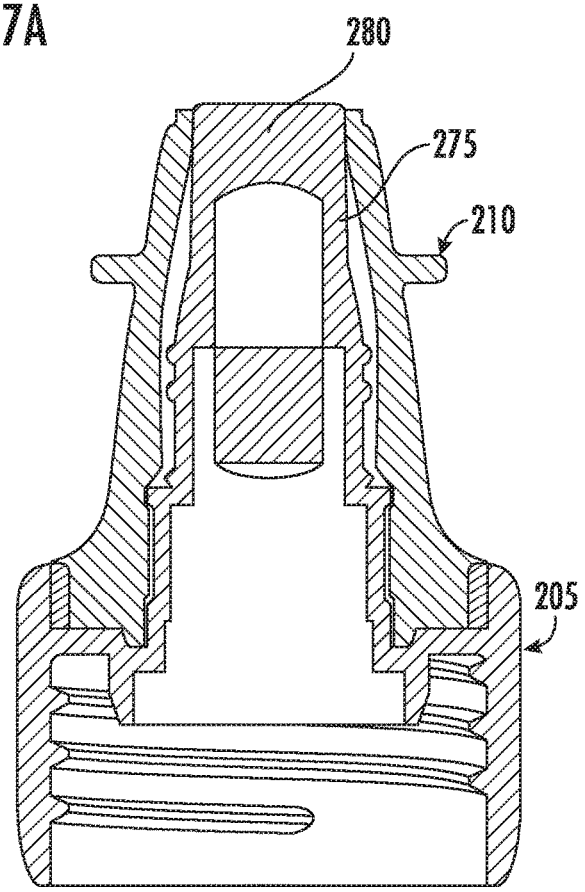
FIG. 7C is a cross-sectional front view of the anti-clog cap of FIG. 7A.
Figure 8A:
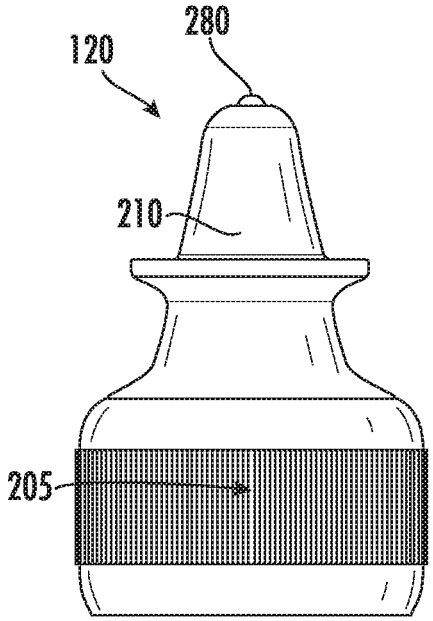
FIG. 8A is a front view of one embodiment of an anti-clog cap in a closed position.
Figure 8B:
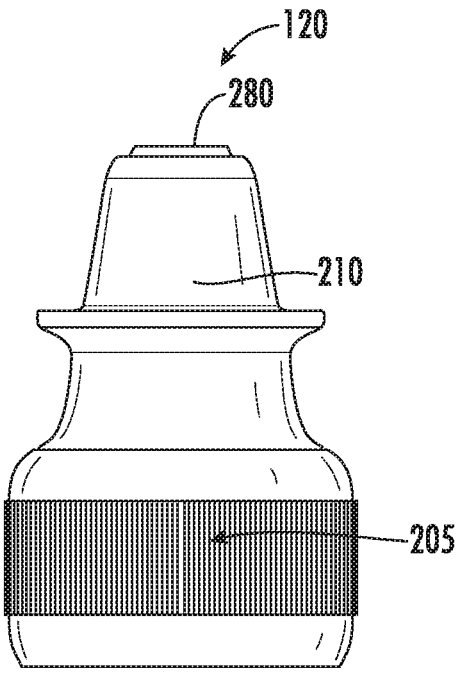
FIG. 8B is a side view of the anti-clog cap of FIG. 8A in a closed position.
Figure 8C:
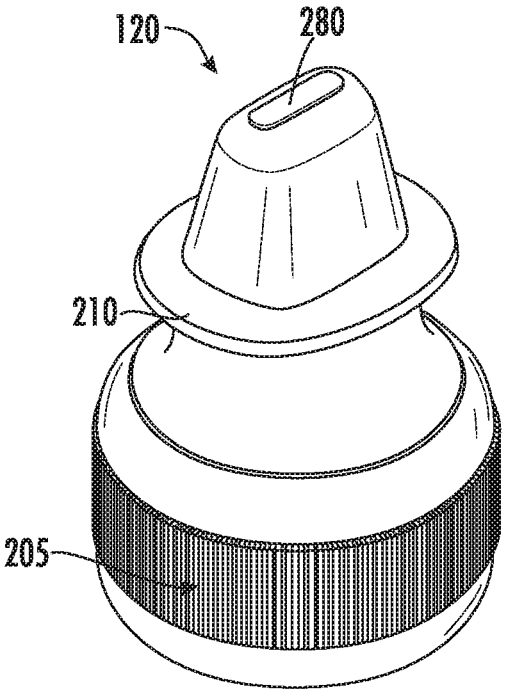
FIG. 8C is a top perspective view of the anti-clog cap of FIG. 8A in a closed position.
Figure 9:
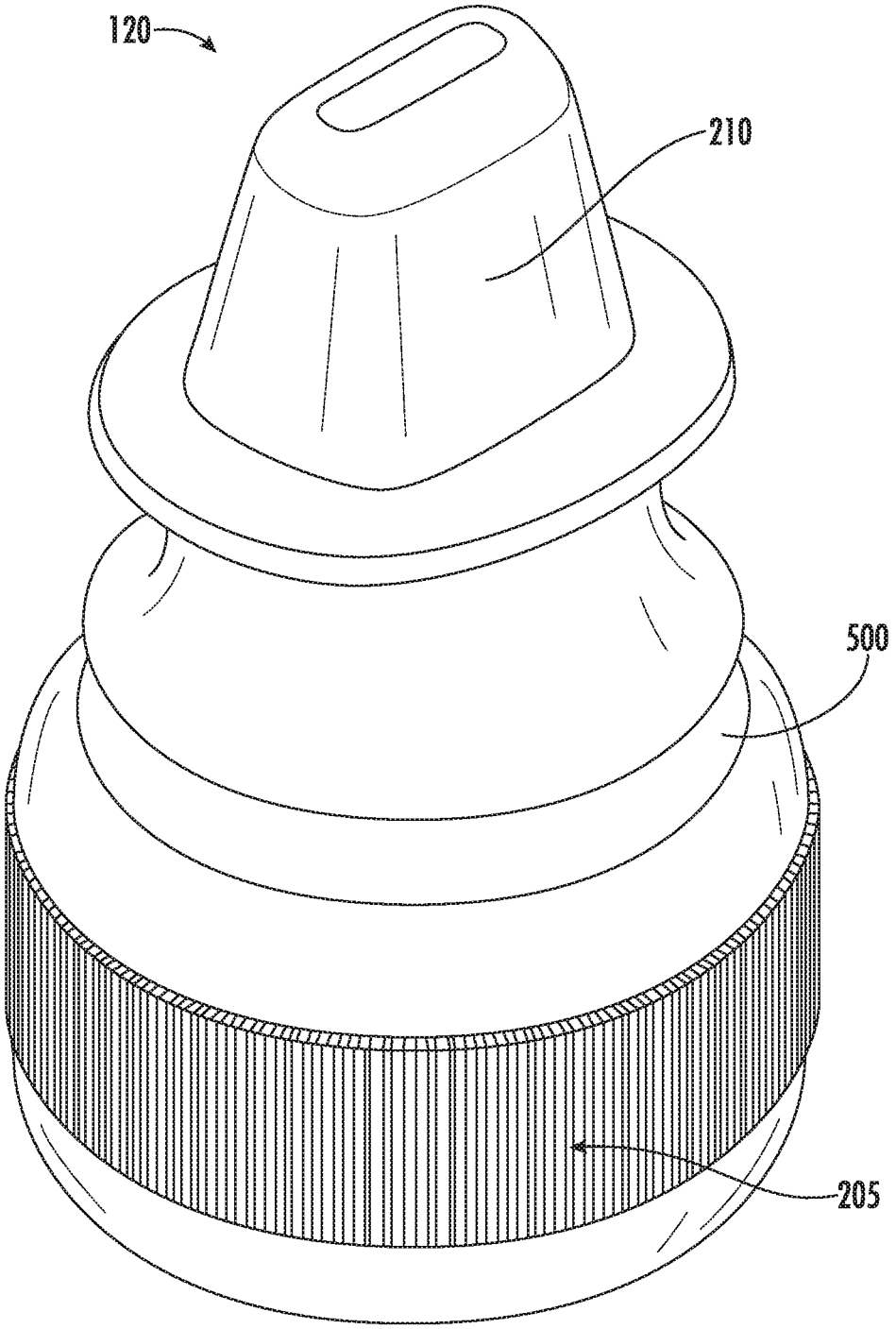
FIG. 9 is a top perspective view of the anti-clog cap of FIG. 8A in an open position.

In one example embodiment, as shown in FIGS. 6A and 6B, the tip plug 605 may be longer than the overall length of the cap body and nozzle. The tip plug may extend proximally beyond the mounting section 230, and the fixation elements 610 may extend proximally from the body 205 to attach at the proximal end of the tip plug 605.

Figure 3A:
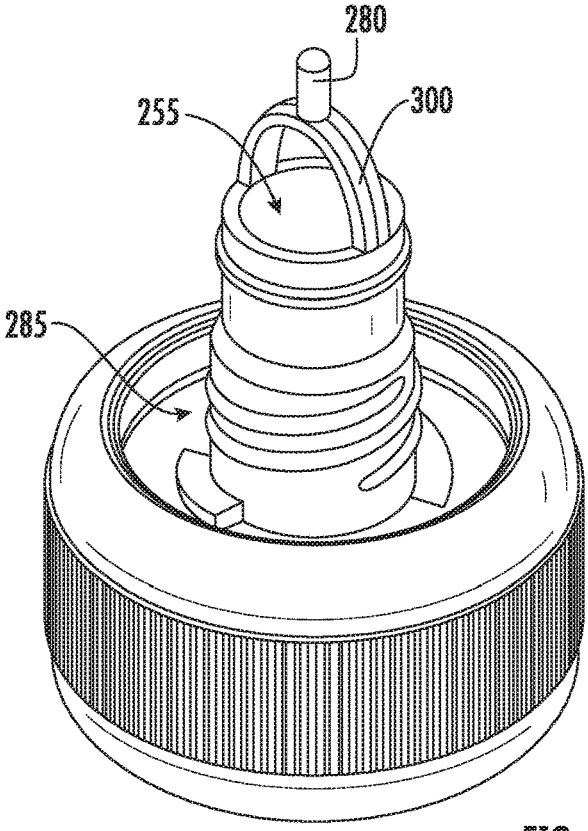
FIG. 3A is a top perspective view of one embodiment of an anti-clog cap.
Figure 3B:
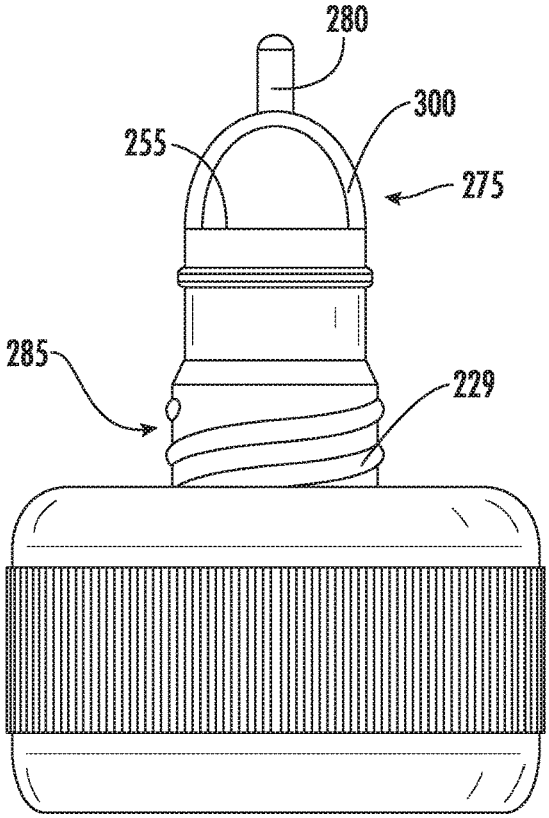
FIG. 3B is a front view of the anti-clog cap of FIG. 3A.

As shown in FIG. 2C, in some embodiments, the support rib 275 may be dimensioned to approximately follow the interior profile of the nozzle 210 along at least one plane, maximizing the area bounded by the support rib 275 and the outlet end 255 of the dispensing section 245. As is shown in FIGS. 2B-C and 3A and B, the support rib 275 may be an arcuate rib 300 extending distally from a first position on the outlet end 255 of the dispensing section 245, passing through a longitudinal centerline of the central lumen 260, and terminating at a second position on the outlet end 255 of the dispensing section 245 (effectively creating an arch over the central lumen 260). In some embodiments, the minimum radius of curvature of the arcuate rib 300 may be greater than the radius of the central lumen 260. In one exemplary embodiment, the radius of the central lumen 260 may be about 4.11 mm.

In another exemplary embodiment, the anti-clog cap 120 includes a body 205 and a nozzle 210, and the nozzle 210 includes a proximal end, adapted for attachment to the body 205, and a distal end with a tip orifice 225. The body may include an attachment end 235 (also referred to as a "first mounting end") adapted for mounting the cap 120 to a glue bottle, a dispensing end 240 (also referred to as a "second mounting end") adapted for dispensing glue, an outer surface 285 for cooperative engagement with the nozzle 210, and a central lumen 260 extending between the first mounting end 235 and the second mounting end 240, the body 205 further including a support rib 275 and a tip plug 280. In some embodiments, the support rib 275 extends distally from the second mounting end 240 of the body 205, and is dimensioned to facilitate the flow of glue through the cap 120. The tip plug 280 may protrude distally from the support rib 275, in axial alignment with the tip orifice 225. The nozzle 210 may be rotatable between a closed position and an open position, such that when the nozzle 210 is in the closed position, the tip plug 280 extends into the tip orifice 225, substantially preventing the flow of glue through the tip orifice 225, and when the nozzle 210 is in the open position, the tip plug 280 is positioned proximal to the tip orifice 225, to facilitate the free flow of glue through the tip orifice 225.

In yet another exemplary embodiment, the anti-clog cap 120 includes a body 205 that is configured for selective attachment to a glue bottle 100 with an attachment end 235 (also referred to as a "first mounting end") and a dispensing end 240 (also referred to as a "second mounting end"). The second mounting end 240 may include a tubular protrusion 245 (also referred to as a "dispensing section") extending perpendicular to the top plane of second mounting end 240 and having an outer surface 285, an inner lumen 260, and a distal end 255. The distal end 255 may include a support rib 275 protruding distally therefrom, and a tip plug 280 extending distally from the support rib 275. In one exemplary embodiment, the support rib 275 is dimensioned to allow substantially all of the glue to flow proximally through the body 205 towards the glue bottle when the glue bottle is in an upright or semi-upright position. In some embodiments, the cap also includes a nozzle 210, disposed on the body 205 and including a tip orifice 225 at a distal end of the nozzle 210. The nozzle 210 may be selectively movable between an open position and a closed position. The tip plug 280, when the nozzle 210 is in the closed position, may be positioned inside of the tip orifice 225, substantially preventing the flow of glue through the tip orifice 225, and when the nozzle 210 is in the open position, the tip plug 280 may be positioned outside of and proximal to the tip orifice 225, allowing glue to flow through the tip orifice 225. In some exemplary embodiments, the nozzle 210 may be movable linearly along a longitudinal axis of the cap 120, while in other embodiments, the nozzle 210 is rotatably movable about the longitudinal axis of the cap 120.

In another example embodiment, the anti-clog cap 120 includes a nozzle 210 with a mating end 215 adapted for attachment to the body, and a distal end 220 that includes a tip orifice 225. The cap may also include a body 205 with a mounting section 230 that has a first mounting end 235 adapted for mounting the body to a glue bottle, and a second mounting end 240. The cap 120 may further include a dispensing section 245 extending distally from the second mounting end 240 and including an inlet end 250, adjacent to the second mounting end 240, an outlet end 255 opposite the inlet end 250, and a central lumen 260 extending between the inlet end 250 and the outlet end 255. In one example, as shown in FIGS. 6A and B, the cap may include a plug assembly 600 with tip plug 605 (e.g., a solid cylindrical tip plug) and one or more fixation elements 610 positioning the cylindrical tip plug 280 coaxially with the longitudinal axis of the cap 120 and the tip orifice 225 and attaching to the body 205 at a position proximal to the outlet end 255. The nozzle 210 may be rotatable between a closed position and an open position, such that when the nozzle 210 is in the closed position, the tip plug 605 extends into the tip orifice 225, substantially preventing the flow of glue through the tip orifice 225, and when the nozzle 210 is in the open position, the tip orifice 225 is positioned distal to the tip plug 605, to facilitate the free flow of glue through the tip orifice 225.

The anti-clog cap 120 may come in various geometries depending on the particular application. In certain embodiments, the nozzle 210 may be generally bullet shaped, having a generally cylindrical midsection and a generally conical tip with a cylindrical tip orifice 225 as shown in FIGS. 2A-C. In such embodiments, the nozzle 210 may cooperatively engage with the body 205 and be configured to allow for the rotational adjustment of the nozzle 210 between an open position and a closed position. In other embodiments, the nozzle 210 may have a generally conical shape, or, as shown in FIGS. 7A-7C and FIG. 9, a composite conical shape with a generally oblong cross section and tip orifice. In some embodiments, the nozzle 210 may cooperatively engage with the body 205 and be configured to allow for push/pull axial displacement of the nozzle 210, allowing the nozzle 210 to be pulled from the closed position to the open position, or pushed from the open position to the closed position. Additional embodiments may utilize different combinations of geometries and combinations of axial and rotational displacement.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific core plug configurations, it will be appreciated that numerous other core plug configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. An anti-clog cap for a glue bottle, comprising:

a body that comprises:

a mounting section comprising a first mounting end adapted for mounting the body to a glue bottle, and a second mounting end;

a dispensing section extending distally from the second mounting end and comprising an inlet end adjacent to the second mounting end of the mounting section, an outlet end opposite the inlet end, and a central lumen extending between the inlet end and the outlet end; and a tip section extending distally from the outlet end of the dispensing section, the tip section comprising a support rib protruding distally from the outlet end of the dispensing section, and a tip plug protruding distally from the support rib, wherein the support rib is an arcuate rib extending distally from a first position on the outlet end of the dispensing section, passing through a longitudinal centerline of the central lumen, and terminating at a second position on the outlet end of the dispensing section;

a nozzle that comprises a mating end adapted for attachment to the body, and a distal end comprising a tip orifice, the tip orifice being in axial alignment with the tip plug of the body, wherein the tip section of the body is dimensioned to facilitate the free flow of glue through the cap, and wherein the nozzle is rotatable between a closed position and an open position, such that when the nozzle is in the closed position, the tip plug extends into the tip orifice, substantially preventing the flow of glue through the tip orifice, and when the nozzle is in the open position, the tip plug is positioned outside of and proximal to the tip orifice, to facilitate the free flow of glue through the tip orifice.

2. The cap of claim 1, further comprising a status indicator, which indicates whether the nozzle is in the open or closed position or indicates a transition between the open and closed positions.

3. The cap of claim 2, wherein the status indicator is a visual indicator.

4. The cap of claim 3, wherein:

the visual indicator comprises a visualization element disposed on the nozzle and the second mounting end of the body comprises a recess, and the visualization element is configured such that when the nozzle is in the open position, the visualization element is visible, and when the nozzle is in the closed position, the visualization element is positioned in the recess, hiding the visualization element from view.

5. The cap of claim 4, wherein the visualization element is a band of color different than the color of the rest of the nozzle.

6. The cap of claim 2, wherein the status indicator is an audible and/or tactile indicator.

7. The cap of claim 6, wherein:

the status indicator comprises a first interference element disposed on the nozzle and a second interference element disposed on the body, and the first interference element and the second interference element are configured to provide audible and/or tactile feedback to the user when the nozzle is rotated from the open position to the closed position.

8. The cap of claim 1, wherein the nozzle is generally bullet shaped, having a generally cylindrical midsection and a generally conical tip, and where the tip orifice is cylindrical.

9. The cap of claim 1, wherein the nozzle has a generally conical shape.

10. The cap of claim 1, wherein the support rib is dimensioned to approximately follow the interior profile of the nozzle along at least one plane.

11. The cap of claim 1, wherein the minimum radius of curvature of the arcuate rib is greater than the radius of the central lumen.

12. The cap of claim 1, wherein the radius of the central lumen is at least 4.11 mm.

13. An anti-clog cap for a glue bottle, comprising:

a body comprising:

a mounting section comprising a first mounting end adapted for mounting the body to a glue bottle, and a second mounting end; and a dispensing section extending distally from the second mounting end and comprising an inlet end, adjacent to the mounting end, an outlet end opposite the inlet end, and a central lumen extending between the inlet end and the outlet end;

a nozzle comprising a mating end adapted for attachment to the body, and a distal end, comprising a tip orifice; and a plug assembly comprising a tip plug and a plurality of fixation elements, the fixation elements positioning the tip plug coaxially with the longitudinal axis of the central lumen and the tip orifice and attaching to the body at a position proximal to the outlet end;

wherein the tip plug is longer than a length of the body and the nozzle, such that the tip plug extends proximally beyond the mounting section, and the fixation elements extend proximally from the body and attach at the proximal end of the tip plug, and wherein the nozzle is rotatable between a closed position and an open position, such that when the nozzle is in the closed position, the tip plug extends into the tip orifice, substantially preventing the flow of glue through the tip orifice, and when the nozzle is in the open position, the tip orifice is positioned distal to the tip plug, to facilitate the free flow of glue through the tip orifice.

14. The cap of claim 13, wherein the tip plug comprises a solid cylinder.

* * * * *